US010738396B2

(12) United States Patent
Jhunjhunwala

(10) Patent No.: US 10,738,396 B2
(45) Date of Patent: Aug. 11, 2020

(54) PROLIFERATED THREAD COUNT OF A WOVEN TEXTILE BY SIMULTANEOUS INSERTION WITHIN A SINGLE INSERTION EVENT OF A LOOM APPARATUS MULTIPLE ADJACENT PARALLEL YARNS DRAWN FROM A MULTI YARN PACKAGE

(71) Applicant: Sachin Jhunjhunwala, Mumbai (IN)

(72) Inventor: Sachin Jhunjhunwala, Mumbai (IN)

( * ) Notice: Subject to any disclaimer, the term of this patent is extended or adjusted under 35 U.S.C. 154(b) by 39 days.

(21) Appl. No.: 15/824,073

(22) Filed: Nov. 28, 2017

(65) Prior Publication Data

US 2018/0298529 A1 Oct. 18, 2018

(30) Foreign Application Priority Data

Apr. 17, 2017 (IN) ..... 201721013639

(51) Int. Cl.

| | |
|---|---|
| ***D03D 1/00*** | (2006.01) |
| ***D03D 13/00*** | (2006.01) |
| ***D03D 49/26*** | (2006.01) |
| ***D03D 15/00*** | (2006.01) |
| *D03D 23/00* | (2006.01) |
| *D01F 6/62* | (2006.01) |

(52) U.S. Cl.

CPC ..... *D03D 13/008* (2013.01); *D03D 1/0017* (2013.01); *D03D 13/002* (2013.01); *D03D 15/00* (2013.01); *D03D 49/26* (2013.01); *D01F 6/62* (2013.01); *D10B 2201/02* (2013.01); *D10B 2331/04* (2013.01); *D10B 2401/063* (2013.01); *D10B 2503/06* (2013.01)

(58) Field of Classification Search

CPC .... D03D 1/0017; D03D 13/008; D03D 15/00; D03D 13/004; D03D 1/00; D03D 47/30; D03D 47/3046; D03D 47/3066; D03D 13/002; D03D 49/26; D10B 2503/06; D10B 2201/02; D10B 2331/04; D10B 2503/062; A47G 9/0238

See application file for complete search history.

(56) References Cited

U.S. PATENT DOCUMENTS

| | | | | | |
|---|---|---|---|---|---|
| 1,334,901 | A * | 3/1920 | Higdon | A61G 7/1026 | 5/500 |
| 4,191,221 | A * | 3/1980 | Boyer | D02G 3/36 | 139/426 R |
| 4,352,380 | A * | 10/1982 | Owen | D02G 3/36 | 139/416 |
| 4,534,819 | A * | 8/1985 | Payet | B29C 65/7443 | 156/515 |
| 4,578,306 | A * | 3/1986 | Heiman | D03D 15/00 | 139/420 R |
| 4,724,183 | A * | 2/1988 | Heiman | D03D 15/00 | 139/420 A |
| 4,896,406 | A * | 1/1990 | Weingarten | D02G 3/367 | 28/166 |
| 5,191,777 | A * | 3/1993 | Schnegg | D04B 21/165 | 66/190 |
| 5,217,796 | A * | 6/1993 | Kasai | D06C 29/00 | 428/408 |
| 5,244,718 | A * | 9/1993 | Taylor | A61F 13/00017 | 139/420 A |
| 5,400,831 | A * | 3/1995 | Gheysen | D03D 27/10 | 139/21 |
| 5,487,936 | A * | 1/1996 | Collier | D03D 15/00 | 428/903 |
| 5,495,874 | A * | 3/1996 | Heiman | D03D 15/00 | 139/420 A |
| 9,131,790 | B2 * | 9/2015 | Agarwal | A47G 9/0238 | |
| 9,481,950 | B2 * | 11/2016 | Agarwal | A47G 9/0238 | |
| 9,493,892 | B1 * | 11/2016 | Agarwal | A47G 9/0238 | |
| 9,708,737 | B2 * | 7/2017 | Agarwal | A47G 9/0238 | |
| 10,066,324 | B2 * | 9/2018 | Agarwal | A47G 9/0238 | |
| 10,101,130 | B2 * | 10/2018 | Citterio | D06M 15/00 | |
| 2004/0031098 | A1 * | 2/2004 | Hollander | A47G 9/02 | 5/482 |
| 2004/0055660 | A1 * | 3/2004 | Heiman | D03D 15/00 | 139/420 R |
| 2005/0095939 | A1 * | 5/2005 | Heiman | D03D 15/00 | 442/208 |
| 2005/0109418 | A1 * | 5/2005 | Liao | D03D 15/08 | 139/420 R |
| 2006/0180229 | A1 * | 8/2006 | Heiman | D03D 15/00 | 139/420 R |
| 2007/0014967 | A1 * | 1/2007 | Tingle | D03D 15/00 | 428/96 |
| 2008/0057813 | A1 * | 3/2008 | Tingle | D03D 15/00 | 442/203 |
| 2009/0260707 | A1 * | 10/2009 | Aneja | A47G 9/0238 | 139/420 R |
| 2011/0111666 | A1 * | 5/2011 | Kim | D03D 13/008 | 442/239 |
| 2011/0133011 | A1 * | 6/2011 | Lee | B65H 51/015 | 242/166 |
| 2012/0009405 | A1 * | 1/2012 | Krishnaswamy | B32B 5/024 | 428/219 |
| 2015/0322597 | A1 * | 11/2015 | Agarwal | A47G 9/0238 | 139/420 R |
| 2016/0222554 | A1 * | 8/2016 | Agarwal | A47G 9/0238 | |
| 2017/0016153 | A1 * | 1/2017 | Agarwal | A47G 9/0238 | |
| 2017/0175303 | A1 * | 6/2017 | Agarwal | D03D 1/0017 | |
| 2017/0314169 | A1 * | 11/2017 | Agarwal | A47G 9/0238 | |
| 2018/0163327 | A1 * | 6/2018 | Jhunjhunwala | D03D 1/0017 | |
| 2018/0298529 | A1 * | 10/2018 | Jhunjhunwala | D03D 13/008 | |
| 2018/0371650 | A1 * | 12/2018 | Agarwal | D03D 15/00 | |

* cited by examiner

*Primary Examiner* — Robert H Muromoto, Jr.
(74) *Attorney, Agent, or Firm* — Wenderoth, Lind & Ponack, L.L.P.

(57) ABSTRACT

A method, a device and/or a system of proliferating a thread count of a woven textile by simultaneous insertion within a single insertion event of a loom apparatus. In one or more embodiments, multiple texturized polyester weft yarns of denier between 7 D and 200 D are wound on a single bobbin in a parallel adjacent fashion such that they may be fed into an Sulzer/projectile insertion apparatus to weave a textile that has between 90 to 250 ends per inch cotton warp yarns and between 100 and 1200 polyester weft yarns.

14 Claims, No Drawings

PROLIFERATED THREAD COUNT OF A WOVEN TEXTILE BY SIMULTANEOUS INSERTION WITHIN A SINGLE INSERTION EVENT OF A LOOM APPARATUS MULTIPLE ADJACENT PARALLEL YARNS DRAWN FROM A MULTI YARN PACKAGE

FIELD OF INVENTION

This disclosure relates generally to textiles and, more particularly, to a method, a device and/or a system of a proliferated thread count of a woven textile by simultaneous insertion within a single insertion event of a loom apparatus multiple adjacent parallel yarns drawn from a multi yarn package.

BACKGROUND OF THE INVENTION

A consumer textile, for example apparel or bed sheets, may possess several characteristics that make it desirable. One desirable characteristic may be comfort for fabrics that come in contact with human skin. Another desirable characteristic may be durability, as consumer textiles may be laundered in machine washers and dryers that may tend to shorten the useful lifespan of the textile. In commercial operations, machine laundering may occur more than in residential or small-scale settings, which may further shorten the lifespan of the textile.

For textiles that contact human skin (for example T-shirts, underwear, bed sheets, towels, pillowcases), one method to increase comfort may be to use cotton yarns. Cotton may have high absorbency and breathability. Cotton may also generally be known to have a good "feel" to consumers.

But cotton may not be robust when placed in an environment with heavy machine laundering. To increase durability while retaining the feel and absorbency of cotton, the cotton yarns may be woven in combination with synthetic fibers such as polyester. Cotton may be used as warp yarns, while synthetic yarns may be used as weft yarns.

Constructing the textile using yarns with a smaller denier may also increase comfort. Using these relatively fine yarns may yield a higher "thread count." A thread count of a textile may be calculated by counting the total weft yarns and warp yarns in along two adjacent edges of a square of fabric that is one-inch by one-inch. The thread count may be a commonly recognized indication of the quality of the textile, and the thread count may also be a measure that consumers associate with tactile satisfaction and opulence.

However, fine synthetic weft yarns, such as polyester, may break when fed into a loom apparatus. Cotton-polyester hybrid weaves may therefore be limited to larger denier synthetic yarns that the loom may effectively use. Thus, the thread count, and its associated comfort and luxury, may be limited.

In an attempt to claim high thread counts, some textile manufacturers may twist two yarns together, such that they may be substantially associated, before using them as a single yarn in a weaving process. A twisted yarn may yield properties in the textile similar to the use of a large denier yarn. Manufactures of textiles with twisted yarns may include within the advertised "thread count" each strand within each twisted yarn, even though the textile may not feel of satisfactory quality once it has been removed from its packaging and handled by the consumer. The Federal Trade Commission has taken the position in an opinion letter that it considers the practice of including each yarn within a twisted yarn in the thread count as deceptive to consumers.

Because fine denier yarns may break in a loom apparatus, cotton-synthetic blends may be limited to low thread counts and thus relatively low quality and comfort.

SUMMARY OF THE PRESENT INVENTION

Disclosed are a method, a device and/or a system of proliferated thread count of a woven textile by simultaneous insertion within a single insertion event of a loom apparatus multiple adjacent parallel yarns drawn from a multi yarn package.

In one aspect of the invention, a woven textile fabric includes from 90 to 250 ends per inch warp yarns and from 100 to 1200 picks per inch multi-filament polyester weft yarns. The picks are woven into the textile fabric in groups of at least two multi-filament polyester weft yarns running on Sulzer/projectile looms. The multi-filament polyester weft yarns are wound in a substantially parallel form to one another. In addition, the multi-filament polyester weft yarns are wound substantially adjacent to one another on a multi yarn package to enable the simultaneous inserting of the multi-filament polyester weft yarns during a single insertion event of an insertion apparatus of a loom apparatus.

Further, the number of the multi-filament polyester weft yarns wound on the weft yarn package using the single insertion and in a substantially parallel form to one another and substantially adjacent to one another is at least two. The number of the multi-filament polyester weft yarns conveyed by the insertion apparatus across a warp shed of the loom apparatus through a set of warp yarns in the single insertion event of the insertion apparatus of the loom apparatus is between one and eight.

The multi-filament polyester weft yarns are wound on the multi yarn package at an angle of between 27 and 30 degrees to enable the simultaneous inserting of the multi-filament polyester weft yarns during the single insertion event of the insertion apparatus of the loom apparatus.

The woven textile fabric may be made of multi-filament polyester yarns having a denier of 7 D to 200 D.

Additionally, the multi-filament polyester yarns may contain 7 to 30 filaments each. The woven textile fabric may have a total thread count from 190 to 1450. The woven textile fabric may have a minimum tensile strength in a warp direction between 17 kilograms to 65 kilograms and a minimum tensile strength in a weft direction between 11.5 kilograms to 100 kilograms. The woven textile fabric may have a warp-to-fill ratio that is between 1:2 to 1:4. The weft yarns within each group run may parallel to each other in a plane which substantially includes the warp yarns. Each of the groups may be made up of at least four multi-filament polyester weft yarns.

In another aspect of the invention, a woven textile fabric includes from 90 to 250 ends per inch warp yarns and from 100 to 1200 picks per inch multi-filament polyester weft yarns. The warp yarns are made of a cotton material and the picks are woven into the textile fabric in groups of at least two multi-filament polyester weft yarns running on Sulzer/projectile looms. The weft yarns within each group run parallel to each other in a plane which substantially includes the warp yarns. In addition, the multi-filament polyester weft yarns are wound in a substantially parallel form to one another and substantially adjacent to one another on a multi yarn package to enable the simultaneous inserting of the multi-filament polyester weft yarns during a single insertion event of an insertion apparatus of a loom apparatus.

Further, the number of the multi-filament polyester weft yarns wound on the weft yarn package in a substantially parallel form to one another and substantially adjacent to one another is at least two. The number of the multi-filament polyester weft yarns conveyed by the insertion apparatus across a warp shed of the loom apparatus through a set of warp yarns in the single insertion event of the insertion apparatus of the loom apparatus is between one and eight. Additionally, the multi-filament polyester weft yarns are wound on the multi yarn package at a type A shore hardness of between 87 to 90 to enable the simultaneous inserting of the multi-filament polyester weft yarns during the single insertion event of the insertion apparatus of the loom apparatus.

In another aspect, a method of a woven textile fabric includes forming 190 to 1450 threads per inch fine textile fabric. The method forms the woven textile having from 90 to 250 ends per inch warp yarns and from 100 to 1200 picks per inch multi-filament polyester weft yarns. The picks are woven into the textile fabric using single multi-filament polyester weft yarn. Additionally, the multi-filament polyester weft yarn is wound on a single yarn package to enable inserting of the multi-filament polyester weft yarn during a single insertion event of an insertion apparatus of a loom apparatus.

Further, the number of the multi-filament polyester weft yarns conveyed by the insertion apparatus across a warp shed of the loom apparatus through a set of warp yarns in the single insertion event of the insertion apparatus of the loom apparatus is at least one.

In another aspect of the invention, a method of weaving a fabric includes drawing multiple polyester weft yarns from a weft source to a pick insertion apparatus of a loom apparatus. The method also includes conveying by the pick insertion apparatus the multiple polyester weft yarns across a warp shed of the loom apparatus through a set of warp yarns in a single insertion event of the insertion apparatus of the loom apparatus and beating the multiple polyester weft yarns into a fell of the fabric with a reed apparatus of the loom apparatus such that the set of warp yarns and/or the multiple polyester weft yarns become interlaced into a woven textile fabric.

The method forms the woven textile having from 90 to 250 ends per inch warp yarns and from 100 to 1200 picks per inch multi-filament polyester weft yarns. In addition, the warp yarns are made of a cotton material. The picks are woven into the textile fabric in groups of two multi-filament polyester weft yarns running on Sulzer/projectile looms. The weft yarns within each group run parallel to each other in a plane which substantially includes the warp yarns. Further, the multi-filament polyester weft yarns are wound in a substantially parallel form to one another.

Additionally, the multi-filament polyester weft yarns are wound substantially adjacent to one another on a multi yarn package to enable the simultaneous inserting of the multi-filament polyester weft yarns during a single insertion event of an insertion apparatus of a loom apparatus. Furthermore, the number of the multi-filament polyester weft yarns wound on the weft yarn package using the single insertion and in a substantially parallel form to one another and substantially adjacent to one another is two.

In addition, the number of the multi-filament polyester weft yarns conveyed by the insertion apparatus across a warp shed of the loom apparatus through a set of warp yarns in the single insertion event of the insertion apparatus of the loom apparatus is between one and eight. The multi-filament polyester weft yarns are wound on the multi yarn package at an angle of between 27 and/or 30 degrees to enable the simultaneous inserting of the multi-filament polyester weft yarns during the single insertion event of the insertion apparatus of the loom apparatus.

The multiple polyester weft yarns may be wound on the yarn package at an angle of between 27 and/or 30 degrees to enable the simultaneous inserting of the multiple polyester weft yarns during the single insertion event of the insertion apparatus of the loom apparatus.

The denier of the polyester weft yarns may be between 7 D and 200 D. Further, the multiple polyester weft yarns may be treated with a conning oil comprising a petroleum hydrocarbon, an emulsifier and/or a surfactant to enable the simultaneous inserting of the multiple polyester weft yarns during the single pick insertion event of the pick insertion apparatus of the loom apparatus.

The multiple polyester weft yarns may be treated with a primary heater heated to approximately 180 degrees Celsius to enable the simultaneous inserting of the multiple polyester weft yarns during the single pick insertion event of the pick insertion apparatus of the loom apparatus, and the multiple polyester weft yarn may be treated with a cooling plate at a temperature of between 0 and 25 degrees Celsius subsequent to the treating with the primary heater.

In yet another aspect of the invention, a bedding material having the combination of the "feel" and absorption characteristics of cotton and the durability characteristics of polyester with multi-filament polyester weft yarns having a denier of between 7 D and 200 D and cotton warp yarns woven in a loom apparatus that simultaneously inserts multiple of the multi-filament polyester weft yarns during a single pick insertion event of the loom apparatus in a parallel fashion such that each of the multiple polyester weft yarns maintain a physical adjacency between each other during the single pick insertion event, increasing the thread count of a woven fabric of the bedding material based on the usage of multi-filament polyester weft yarns with a denier between 7 D and 200 D. The bedding is a woven textile fabric that includes from 90 to 250 ends per inch warp yarns and from 100 to 1200 picks per inch multi-filament polyester weft yarns.

In a further aspect of the invention, a method of woven textile fabric includes forming of 1200 threads per inch fine textile fabric. The woven textile fabric is made from 90 to 235 ends per inch warp yarns and from 100 to 965 picks per inch single multi-filament polyester weft yarn. The picks are woven into the textile fabric using single multi-filament polyester weft yarn. In addition, the multi-filament polyester weft yarn is wound on a single-pick yarn package to enable inserting of the multi-filament polyester weft yarn during a single pick insertion event of a pick insertion apparatus of a loom apparatus.

Further, the number of the multi-filament polyester weft yarn conveyed by the pick insertion apparatus across a warp shed of the loom apparatus through a set of warp yarns in the single pick insertion event of the pick insertion apparatus of the loom apparatus is one. Additionally, the pick insertion apparatus of the loom apparatus is a Sulzer/projectile insertion apparatus. Further, the multi-filament polyester weft yarn is wound on the single-pick yarn package at an angle of between 27 and 30 degrees to enable inserting of the multi-filament polyester weft yarn during the single pick insertion event of the pick insertion apparatus of the loom apparatus.

The methods and systems disclosed herein may be implemented in any means for achieving various aspects, and may be executed in a form of a non-transitory machine-readable medium embodying a set of instructions that, when executed by a machine, cause the machine to perform any of the operations disclosed herein. Other features will be apparent from the detailed description that follows.

DETAILED DESCRIPTION OF THE INVENTION

Disclosed are a method, a device and a system of a proliferated thread count of a woven textile by simultaneous insertion within a single pick insertion event of a loom apparatus multiple adjacent parallel yarns drawn from a multi-pick yarn package. Although the present embodiments have been described with reference to specific example embodiments, it will be evident that various modifications and changes may be made to these embodiments without departing from the broader spirit and scope of the various embodiments.

In one embodiment, a woven textile fabric includes from 90 to 250 ends per inch warp yarns and from 100 to 1200 picks per inch multi-filament polyester weft yarns. The picks are woven into the textile fabric in groups of at least two multi-filament polyester weft yarns (e.g., adjacent parallel yarns, parallel binary yarns) running in a parallel form to one another. The multi-filament polyester weft yarns (e.g., adjacent parallel yarns, parallel binary yarns) are wound in a substantially parallel form to one another, according to one embodiment.

In addition, the multi-filament polyester weft yarns are wound substantially adjacent to one another on a multi-pick yarn package to enable the simultaneous inserting of the multi-filament polyester weft yarns (e.g., adjacent parallel yarns, parallel binary yarns) during a single pick insertion event of a pick insertion apparatus of a loom apparatus, according to one embodiment.

Further, the number of the multi-filament polyester weft yarns (e.g., adjacent parallel yarns, parallel binary yarns) wound on the weft yarn package (e.g., multi-pick yarn package, binary pick-yarn package) using the single pick insertion and in a substantially parallel form to one another and substantially adjacent to one another is at least two. The number of the multi-filament polyester weft yarns (e.g., adjacent parallel yarns, parallel binary yarns) conveyed by the pick insertion apparatus across a warp shed of the loom apparatus through a set of warp yarns in the single pick insertion event of the pick insertion apparatus of the loom apparatus is between one and eight, according to one embodiment.

The pick insertion apparatus of the loom apparatus is a Sulzer/projectile insertion apparatus. The multi-filament polyester weft yarns (e.g., adjacent parallel yarns, parallel binary yarns) are wound on the multi-pick yarn package at an angle of between 27 and 30 degrees to enable the simultaneous inserting of the multi-filament polyester weft yarns (e.g., adjacent parallel yarns, parallel binary yarns, single yarn) during the single pick insertion event of the pick insertion apparatus of the loom apparatus, according to one embodiment.

In addition, the woven textile fabric may be made of multi-filament polyester yarns having a denier of 7 D to 200 D. The warp yarns may be made of a cotton material.

Additionally, the multi-filament polyester yarns (e.g., adjacent parallel yarns, parallel binary yarns, single yarn) may contain 7 to 30 filaments each. The woven textile fabric may have a total thread count from 190 to 1450. The woven textile fabric may have a minimum tensile strength in a warp direction of 17 kilograms to 65 kilograms and a minimum tensile strength in a weft direction of 11.5 kilograms to 100 kilograms. The woven textile fabric may have a warp-to-fill ratio that is between 1:2 to 1:4, according to one embodiment.

The weft yarns (e.g., adjacent parallel yarns, parallel binary yarns) within each group run may parallel to each other in a plane which substantially includes the warp yarns. Each of the groups may be made up of at least four multi-filament polyester weft yarns (e.g., adjacent parallel yarns, parallel binary yarns), according to one embodiment.

In another embodiment, a woven textile fabric includes from 90 to 250 ends per inch warp yarns and from 100 to 1200 picks per inch multi-filament polyester weft yarns (e.g., adjacent parallel yarns, parallel binary yarns). The warp yarns are made of a cotton material and the picks are woven into the textile fabric in groups of at least two multi-filament polyester weft yarns (e.g., adjacent parallel yarns, parallel binary yarns) running in a parallel form to one another. The weft yarns (e.g., adjacent parallel yarns, parallel binary yarns) within each group run parallel to each other in a plane which substantially includes the warp yarns. In addition, the multi-filament polyester weft yarns (e.g., adjacent parallel yarns, parallel binary yarns) are wound in a substantially parallel form to one another and substantially adjacent to one another on a multi-pick yarn package to enable the simultaneous inserting of the multi-filament polyester weft yarns (e.g., adjacent parallel yarns, parallel binary yarns) during a single pick insertion event of a pick insertion apparatus of a loom apparatus.

Further, the number of the multi-filament polyester weft yarns (e.g., adjacent parallel yarns, parallel binary yarns) wound on the weft yarn package (e.g., multi-pick yarn package, binary pick-yarn package) in a substantially parallel form to one another and substantially adjacent to one another is at least two. The number of the multi-filament polyester weft yarns (e.g., adjacent parallel yarns, parallel binary yarns) conveyed by the insertion apparatus across a warp shed of the loom apparatus through a set of warp yarns in the single insertion event of the insertion apparatus of the loom apparatus is between one and eight. Additionally, the multi-filament polyester weft yarns (e.g., adjacent parallel yarns, parallel binary yarns) are wound on the multi-pick yarn package at a type A shore hardness of between 87 to 90 to enable the simultaneous inserting of the multi-filament polyester weft yarns (e.g., adjacent parallel yarns, parallel binary yarns) during the single insertion event of the insertion apparatus of the loom apparatus, according to one embodiment.

In another embodiment, a method of a woven textile fabric includes forming 190 to 1450 threads per inch fine textile fabric. The method forms the woven textile having from 90 to 250 ends per inch warp yarns and from 100 to 1200 picks per inch multi-filament polyester weft yarns (e.g., adjacent parallel yarns, parallel binary yarns). The picks are woven into the textile fabric using single multi-filament polyester weft yarn (e.g., adjacent parallel yarns, parallel binary yarns). Additionally, the multi-filament polyester weft yarn (e.g., adjacent parallel yarns, parallel binary yarns) is wound on a single yarn package to enable inserting of the multi-filament polyester weft yarn (e.g., adjacent parallel yarns, parallel binary yarns) during a single insertion event of an insertion apparatus of a loom apparatus.

Further, the number of the multi-filament polyester weft yarns (e.g., adjacent parallel yarns, parallel binary yarns) conveyed by the insertion apparatus across a warp shed of the loom apparatus through a set of warp yarns in the single insertion event of the insertion apparatus of the loom apparatus is at least one. The insertion apparatus of the loom apparatus is a Sulzer/projectile insertion apparatus, according to one embodiment.

In another embodiment, a method of weaving a fabric includes drawing multiple polyester weft yarns (e.g., adjacent parallel yarns, parallel binary yarns) from a weft source to an insertion apparatus of a loom apparatus, according to one embodiment.

Additionally, the method also includes conveying by the insertion apparatus the multiple polyester weft yarns across a warp shed of the loom apparatus through a set of warp yarns in a single insertion event of the insertion apparatus of the loom apparatus and beating the multiple polyester weft yarns into a fell of the fabric with a reed apparatus of the loom apparatus such that the set of warp yarns and/or the multiple polyester weft yarns (e.g., adjacent parallel yarns, parallel binary yarns) become interlaced into a woven textile fabric, according to one embodiment.

The method forms the woven textile having from 90 to 250 ends per inch warp yarns and from 100 to 1200 picks per inch multi-filament polyester weft yarns (e.g., adjacent parallel yarns, parallel binary yarns). In addition, the warp yarns are made of a cotton material.

The weft yarns within each group run parallel to each other in a plane which substantially includes the warp yarns. Further, the multi-filament polyester weft yarns (e.g., adjacent parallel yarns, parallel binary yarns) are wound in a substantially parallel form to one another, according to one embodiment.

Additionally, the multi-filament polyester weft yarns (e.g., adjacent parallel yarns, parallel binary yarns) are wound substantially adjacent to one another on a multi yarn package to enable the simultaneous inserting of the multi-filament polyester weft yarns during a single insertion event of an insertion apparatus of a loom apparatus. Furthermore, the number of the multi-filament polyester weft yarns wound on the weft yarn package in a substantially parallel form to one another and substantially adjacent to one another is at least two, according to one embodiment.

In addition, the number of the multi-filament polyester weft yarns (e.g., adjacent parallel yarns, parallel binary yarns) conveyed by the insertion apparatus across a warp shed of the loom apparatus through a set of warp yarns in the single insertion event of the insertion apparatus of the loom apparatus is between one and eight. The multi-filament polyester weft yarns (e.g., adjacent parallel yarns, parallel binary yarns) are wound on the multi yarn package at an angle of between 27 and/or 30 degrees to enable the simultaneous inserting of the multi-filament polyester weft yarns during the single insertion event of the insertion apparatus of the loom apparatus, according to one embodiment.

In yet another embodiment, a method of woven textile fabric includes forming of 1200 threads per inch fine textile fabric. The woven textile fabric is made from 90 to 250 ends per inch warp yarns and from 100 to 1200 picks per inch single multi-filament polyester weft yarn. The multi-filament polyester weft yarn is wound on a single yarn package to enable inserting of the multi-filament polyester weft yarn) during a single insertion event of an insertion apparatus of a loom apparatus, according to one embodiment.

The number of the multi-filament polyester weft yarn (e.g., single yarn) conveyed by the insertion apparatus across a warp shed of the loom apparatus through a set of warp yarns in the single insertion event of the insertion apparatus of the loom apparatus is at least one, according to one embodiment.

In another embodiment, the insertion apparatus of the loom apparatus is a Sulzer/projectile insertion apparatus. The multi-filament polyester weft yarn is wound on the single yarn package at an angle of between 27 and 30 degrees to enable inserting of the single multi-filament polyester weft yarn during the single insertion event of the insertion apparatus of the loom apparatus, according to one embodiment.

In an embodiment, in a multi yarn package, two discrete partially-oriented polyester yarns are oriented, texturized, convened to parallel adjacency by a wiper guide, and then wound onto a single multi yarn package, according to one or more embodiments.

In an embodiment, the multi yarn package may be formed from two of the partially oriented polyester yarns (POY) that may be oriented and texturized by a number of elements. The multi yarn package may be used to supply weft yarns (weft yarns may also be known as "fill," "picks," "woof" and/or "filling yarns") in any type of loom apparatus, including those with pick insertion mechanisms such as bullet, magnetic levitation bullet, water jet.

In one preferred embodiment, the loom may use a Sulzer/projectile insertion mechanism. The partially oriented polyester yarn may be comprised of one or more extruded filaments of polyester.

The primary input roller may draw the partially oriented polyester yarn from the supply package. The secondary input roller, which may operate at a higher speed than the primary input roller, may then draw the partially oriented polyester yarn from the primary input roller, forming the oriented polyester yarn. In a preferred embodiment, the secondary input roller rotates at 1.7 times the speed of the primary input roller, according to one embodiment.

The oriented polyester yarn may then be drawn through the primary heater. The primary heaters may be heated to a temperature between 50° C. and 200° C. In one preferred embodiment, the primary heater may be set to 190° C. After leaving the heater, the oriented polyester yarn may then be exposed to the cooling plate that may be set at a temperature between 0° C. and room temperature (e.g., about 20-25° C.). The cooling plate may also be set at temperatures between 25° C. and 40° C., and in one preferred embodiment 38° C.

The intermediate roller may draw the oriented polyester yarn from the cooling plate to the friction twisting unit. The friction twisting unit (e.g., an FTU) may twist/detwist the filaments within the oriented polyester yarn such that it gains a texture (e.g., such that the resulting textile the oriented polyester yarn may be woven into gains in "body" or heft) and may also provide a low stability interlacing in the weaving process, according to one embodiment.

The friction twisting unit may also help to intermingle the polyester filaments that may comprise the oriented polyester yarn. The twist imparted by the friction twisting unit may be translated through the oriented polyester yarn back to the primary heater, which, in conjunction with the cooling plate, may "fix" the molecular structure of the twisted filaments of the oriented polyester yarn, imbuing it with a "memory" of torsion, according to one embodiment.

The intermediate roller may convey the oriented polyester yarn to the intermingling jet that may apply a uniform air pressure to the oriented polyester yarn to provide counter-twist to the friction twisting unit. The oriented polyester yarn may then be heated by the secondary heater. The secondary heater may be set to between 50° C. and 200° C. In one preferred embodiment, the intermingling jet may be set to a pressure of 2 bars and the secondary heater may be set to a temperature of 170° C., according to one embodiment.

The output roller may convey the oriented polyester yarn to the oil applicator. The oil applicator may apply conning oil. The conning oil applied by the oil applicator may act as a lubricant, reducing a friction between two or more yarns (e.g., several of the oriented polyester yarns) and between one or more yarns and a loom apparatus (e.g., metallic components the oriented polyester yarn may contact). The conning oil may also minimize a static charge formation of synthetic yarns. The conning oil may be comprised of a mineral oil (e.g., a petroleum hydrocarbon), a moisture, an emulsifier (e.g., a non-ionic surfactant, a fatty alcohol an ethoxylatlate, and/or a fatty acid), and/or a surfactant, according to one embodiment.

In addition, the conning oil may help prevent a dissociation of the adjacent parallel yarns when the adjacent parallel yarns are propelled across a warp shed during a single insertion event of a loom apparatus, according to one embodiment. The rate at which the oil applicator applies the conning oil may be adjusted to a minimum amount required to prevent dissociation of the adjacent parallel yarns during an insertion event, depending on the type of loom apparatus employed, according to one embodiment.

After conning oil may be applied by the oil applicator, the oriented polyester yarn may be the texturized yarn ready to be wound on a yarn supply package spindle, according to one embodiment.

The wiper guide may collect and convene multiple of the texturized yarns such that the texturized yarns become the adjacent parallel yarns. The adjacent parallel yarns may then enter the traverse guide, which may wind the adjacent parallel yarns onto a spool to form the multi yarn package. The traverse guide may wind the multi yarn package at a crossing wind angle of between 27-30°, and at a type A shore hardness of between 87 and 90, according to one embodiment.

In one preferred embodiment, the number of texturized yarns that may be convened by the wiper guide to be wound onto the multi-pick yarn package may be two. The partially oriented polyester yarn may have a denier of 22.5 with 14 polyester filaments. In another preferred embodiment, the partially oriented polyester yarn may have a denier of between 7 D and 200 D.

One skilled in the art will know that denier may be a unit of measure for a linear mass density of a fiber, such measure defined as the mass in grams per 9000 meters of the fiber. The wiper guide may substantially unite the texturized yarn into the adjacent parallel yarns such that, if considered a unitary yarn, the adjacent parallel yarns may have 28 filaments and a denier of about 45, according to one embodiment. In contrast, if two of the partially oriented polyester yarns with 14 filaments and a denier of 22.5 are twisted around one another, the twisted yarns, if considered a unitary yarn, may have a denier higher than 45 due to increased linear mass density of twisted fibers within a given distance. Yarns twisted in this fashion may also not qualify as independent yarns for calculating thread count according to industry standards of regulatory bodies, according to one embodiment.

In an embodiment, multiple partially oriented polyester yarns may be supplied to input rollers to yield oriented yarn. Multiple oriented yarns are heated by two primary heaters, according to one embodiment.

In an embodiment, the multiple oriented polyester yarns may be cooled by cooling plates. The multiple oriented polyester yarns may be twisted, individually, by friction twisting units. The oriented polyester yarns may be collected by intermediate rollers. The filaments of the oriented polyester yarns may be intermingled, individually, by a uniform pressure of air by intermingling jets to provide lower stability interlacing and help bind the filaments within each individual partially oriented polyester yarn, according to one embodiment.

The multiple of the oriented polyester yarns may be heated by secondary heaters, and the oriented polyester yarns may have conning oil applied to each yarn by oil applicators. The oriented polyester yarns, may be wound onto a single spindle at 87-90 type A shore hardness through the use of a wiper guide and traverse guide to form the multi yarn package, according to one embodiment. One skilled in the art will know that type A shore hardness may be measured using the ASTM D2240 type A durometer scale.

In an embodiment, the multi yarn package is wound with the adjacent parallel yarns comprising two of the texturized yarns. The adjacent parallel yarns may be wound on a bobbin. The bobbin may also be a strait or a tapered bobbin. The crossing wind angle may be the acute angle formed at the intersection between the adjacent parallel yarns deposited in a first pass of the traverse guide and the adjacent parallel yarns in a subsequent pass of the traverse guide, according to one embodiment.

In an embodiment, two adjacent parallel yarns forming a binary yarn package are fed into a Sulzer/projectile apparatus such that they are simultaneously propelled across a warp shed of the loom apparatus in a single insertion event, according to one or more embodiments.

The loom apparatus (e.g., Sulzer/projectile loom) may accept a weft source supplying the adjacent parallel yarns. The loom apparatus may be a Sulzer/projectile apparatus and the weft source may be the binary yarn package, which is the multi yarn package wound with two of the adjacent parallel yarns in accordance with the present invention. The two of the adjacent parallel yarns drawn from the binary yarn package and fed into the loom apparatus may be referred to as the parallel binary yarns, according to one embodiment.

The parallel binary yarns may be fed into the Sulzer/projectile apparatus and the elements thereof in accordance with ordinary practice to one skilled in the art.

For example, the parallel binary yarns from the binary pick yarn package may be fed into an accumulator of the Sulzer/projectile insertion apparatus. The accumulator may be designed to collect and hold in reserve between each of the single insertion events a length of the parallel binary yarns needed to cross the warp shed with a minimal unwinding resistance. Next, the parallel binary yarns may pass into the insertion apparatus.

The parallel binary yarns drawn from the multi yarn package may cross the warp shed in the single insertion event. The single insertion event is the operation and/or process of the insertion apparatus that is known in the art to be ordinarily associated with the projectile of yarns (or yarns comprised of multiple yarns twisted together) across the warp shed, according to one embodiment.

Upon crossing the warp shed of the loom apparatus, the reed apparatus may "beat up" (e.g., perform a beat up motion) the parallel binary yarns, forcing them into the fabric fell (also known as "the fell of the cloth") of the textile that the loom apparatus may be producing. The beat up motion of the reed apparatus may form the warp/weft interlacing of the warp yarns and the parallel binary yarns (the weft yarns), producing an incremental length of the textile, according to one embodiment.

The weft source may be two of the binary yarn packages, each supplying two of the parallel binary yarns (e.g., four of the texturized yarns), that may be fed into the insertion apparatus of the loom apparatus such that the two parallel binary yarns may become the parallel quaternary yarn.

In an alternate embodiment, the weft source of the loom apparatus may be three or more of the multi yarn packages. For example, the weft source may be four binary pick yarn packages. In such a case, eight of the texturized yarns may be projected across the warp shed during the single insertion event. In one embodiment, the highest thread counts may be yielded by using four of the binary yarn packages as the weft source, according to one embodiment.

In a further example embodiment, the weft source of the loom apparatus may be one of the single yarn package(s). In such a case, single yarn of the texturized yarns may be projected across the warp shed during the single insertion event. In one embodiment, the highest thread counts may be yielded by using one of the single yarn packages as the weft source, according to one embodiment.

In yet another embodiment, there may also be an odd number of the texturized yarns (e.g., a tertiary parallel yarns) propelled across the warp shed in the single insertion event, for example of the weft source was composed of the single yarn package (e.g., single-pick yarn package) along with one of the binary yarn packages. The tertiary parallel yarns may also result where the multiyarn package is wound with three of the texturized yarns. In addition, the deniers of the texturized yarns wound on the multi yarn package may be heterogeneous, according to one embodiment.

It will be recognized to one skilled in the art that the loom apparatus may insert yarns in an equal number of the single insertion events.

The woven fabric interlacing that may result when a loom apparatus is configured to interlace the warp yarns and the adjacent parallel yarns drawn from the binary pick yarn package after a single insertion event. Because two of the texturized yarns may be wound on the binary yarn package, the resulting woven fabric interlacing may be a "1 by 2" weave with the weft under warp and weft over warp alternating after each of the warp yarns in the weft direction and alternating after each two of the texturized yarns in the warp direction.

The warp yarns of a textile produced using the multi yarn package may be comprised of natural or synthetic fibers, and the weft yarns may be polyester weft yarns (e.g., the adjacent parallel yarns comprised of multiple of the texturized yarns). In one preferred embodiment, the warp yarns may be made of cotton, according to one embodiment.

The textile produced from the multi yarn package may have between 90 and 250 warp yarn ends per inch, between 100 and 1200 picks per inch, and may have a warp-to-fill ratio between 1:2 and 1:4 (in other words, 1 warp yarn per every 4 weft yarns). The textile produced using the multi yarn package may have a thread count of between 190 to 1450, a minimum tensile strength of 17.0 kg to 65.0 kg (about 37.5 lbs to 143.5 lbs) in the warp direction, and a minimum tensile strength of 11.5 kg to 100.0 kg (about 25.4 lbs to 220.7 lbs) in the weft direction. In one or more embodiments the textile manufactured using the multi yarn package may have a composition of 45-49% texturized polyester yarn (e.g., the texturized yarn) and 51-65% cotton yarn, according to one embodiment.

The partially oriented polyester yarn (that becomes the texturized yarn) may have multiple filaments and may have a denier of between 7 D and 200 D. In one preferred embodiment, the partially oriented polyester yarn may have about a denier of about 20 and have about 14 filaments, according to one embodiment.

The resulting fabric produced may be of exceptionally high quality compared to prior-art cotton-synthetic hybrid weaves due to its high thread count. To further increase quality and comfort of the textile, the fabric may be finished by brushing the surface to increase softness (a process known as "peaching" or "peach finishing"). In addition, various other finishing methods may be used in association with the textile produced from the multi yarn package to increase the resulting textile's quality, according to one embodiment.

In the embodiment of the present invention, the single yarn package may be formed from single partially oriented polyester yarn (POY) that may be oriented and texturized by a number of elements. The single yarn package may be used to supply weft yarn (weft yarns may also be known as "fill," "picks," "woof" and/or "filling yarns") in any type of loom apparatus. In one preferred embodiment, the loom may be Sulzer/projectile loom. The partially oriented polyester yarn may be comprised of one or more extruded filaments of polyester, according to one embodiment.

In one more embodiment, the single yarn package may be formed from single partially oriented polyester yarn (POY) that may be oriented and texturized by a number of elements. In addition, the conning oil may help prevent a dissociation of the single yarn. The rate at which the oil applicator applies the conning oil may be adjusted to a minimum amount required to prevent dissociation of the single yarn during an insertion event (e.g., the single pick insertion event), depending on the type of loom apparatus employed, according to one embodiment.

After conning oil may be applied by the oil applicator, the oriented polyester yarn may be the texturized yarn ready to be wound on a yarn supply package spindle (e.g., to become the single-pick yarn package). The wiper guide may collect and convene multiple of the texturized yarns such that the texturized yarns become the single yarn. The single yarn may then enter the traverse guide, which may wind the single yarn onto a spool to form the single yarn package. The traverse guide may wind the single yarn package at a crossing wind angle of between 5-25°. In one preferred embodiment, the number of texturized yarns that may be convened by the wiper guide to be wound onto the single yarn package may be two, according to one embodiment.

In one preferred embodiment, the partially oriented polyester yarn may have a denier of 22.5 with 14 polyester filaments. In another preferred embodiment, the partially oriented polyester yarn may have a denier of between 7 D and 200 D. One skilled in the art will know that denier may be a unit of measure for a linear mass density of a fiber, such measure defined as the mass in grams per 9000 meters of the fiber, according to one embodiment.

The wiper guide may substantially unite the texturized yarn into the single yarn such that, if considered a unitary yarn, the single yarn may have 28 filaments and a denier of about 45. In contrast, if two of the partially oriented polyester yarns with 14 filaments and a denier of 22.5 are twisted around one another, the twisted yarns, if considered a unitary yarn, may have a denier higher than 45 due to increased linear mass density of twisted fibers within a given distance, according to one embodiment.

In the embodiment, the single yarn package wounds with the single yarn comprising one of the texturized yarns. The single yarn may be wound on a bobbin. The bobbin may also be a straight or a tapered bobbin. The crossing wind angle may be the acute angle formed at the intersection between the single yarn deposited in a first pass of the traverse guide and the single yarn in a subsequent pass of the traverse guide, according to one embodiment.

The loom apparatus (e.g. Sulzer/projectile loom) may accept a weft source supplying the single yarn. The yarn is drawn from the single yarn package and fed into the loom apparatus, according to one embodiment. The single yarn may be fed into the Sulzer/projectile apparatus and the elements thereof in accordance with ordinary practice to one skilled in the art.

For example, the single yarn from the single yarn package may be fed into an accumulator of the Sulzer/projectile insertion apparatus. The accumulator may be designed to collect and hold in reserve between each of the single insertion events a length of the parallel binary yarns needed to cross the warp shed with a minimal unwinding resistance. Next, the single yarn may pass into the insertion apparatus, according to one embodiment.

The single yarn drawn from the single yarn package may cross the warp shed in the single insertion event. The single insertion event is the operation and/or process of the insertion apparatus that is known in the art to be ordinarily associated with the projectile of yarns (or yarns comprised of multiple yarns twisted together) across the warp shed.

Upon crossing the warp shed of the loom apparatus, the reed apparatus may "beat up" (e.g., perform a beat up motion) the parallel binary yarns, forcing them into the fabric fell (also known as "the fell of the cloth") of the textile that the loom apparatus may be producing. The beat up motion of the reed apparatus may form the warp/weft interlacing of the warp yarns and the single yarn (e.g., the weft yarn), producing an incremental length of the textile, according to one embodiment.

In one embodiment, a woven textile fabric includes from 90 to 250 ends per inch warp yarns and from 100 to 1200 picks per inch multi-filament polyester weft yarns. The warp yarns may be made of a cotton material, and may have a total thread count is from 190 to 1000. The woven textile fabric may be made of multi-filament polyester yarns having a denier of 7 D to 200 D.

Additionally, the multi-filament polyester yarns may contain 7 to 30 filaments each. The woven textile fabric may have a minimum tensile strength in a warp direction of 17 kilograms to 65 kilograms and a minimum tensile strength in a weft direction of 11.5 kilograms to 100 kilograms. The woven textile fabric may have a warp-to-fill ratio that is between 1:2 to 1:4, according to one embodiment.

In another embodiment, a method of weaving a fabric includes drawing multiple polyester weft yarns from a weft source to an insertion apparatus of a loom apparatus. The method also includes conveying by the insertion apparatus the multiple polyester weft yarns across a warp shed of the loom apparatus through a set of warp yarns in a single insertion event of the insertion apparatus of the loom apparatus and beating the multiple polyester weft yarns into a fell of the fabric with a reed apparatus of the loom apparatus such that the set of warp yarns and/or the multiple polyester weft yarns become interlaced into a woven textile fabric. The method forms the woven textile having from 90 to 250 ends per inch warp yarns and from 100 to 1200 picks per inch multi-filament polyester weft yarns, according to one embodiment.

The denier of the polyester weft yarns may be between 7 D and 200 D. The weft source may be a weft yarn package in which the multiple polyester weft yarns are wound using a single insertion and in a substantially parallel form to one another and substantially adjacent to one another to enable the simultaneous inserting of the multiple polyester weft yarns during the single insertion event of the insertion apparatus of the loom apparatus, according to one embodiment.

Further, the number of the multiple polyester weft yarns wound substantially parallel to one another and substantially adjacent to one another on the weft yarn package may be at least two. The number of the multiple polyester weft yarns conveyed by the insertion apparatus across the warp shed of the loom apparatus through the set of warp yarns in the single insertion event of the insertion apparatus of the loom apparatus may be between one and eight, according to one embodiment.

The multiple polyester weft yarns may be wound on the yarn package at an angle of between 27 and/or 30 degrees to enable the simultaneous inserting of the multiple polyester weft yarns during the single insertion event of the insertion apparatus of the loom apparatus. Additionally, the multiple polyester weft yarns may be wound on the yarn package at a type A shore hardness of between 87 to 90 to enable the simultaneous inserting of the multiple polyester weft yarns during the single insertion event of the insertion apparatus of the loom apparatus, according to one embodiment.

Further, the multiple polyester weft yarns may be treated with a conning oil comprising a petroleum hydrocarbon, an emulsifier and/or a surfactant to enable the simultaneous inserting of the multiple polyester weft yarns during the single insertion event of the insertion apparatus of the loom apparatus.

The multiple polyester weft yarns may be treated with a primary heater heated to approximately 180 degrees Celsius to enable the simultaneous inserting of the multiple polyester weft yarns during the single insertion event of the insertion apparatus of the loom apparatus, and the multiple polyester weft yarn may be treated with a cooling plate at a temperature of between 0 and 25 degrees Celsius subsequent to the treating with the primary heater, according to one embodiment.

In yet another embodiment, a bedding material having the combination of the "feel" and absorption characteristics of cotton and the durability characteristics of polyester with multi-filament polyester weft yarns having a denier of between 7 D and 200 D and cotton warp yarns woven in a loom apparatus that simultaneously inserts multiple of the multi-filament polyester weft yarns during a single insertion event of the loom apparatus in a parallel fashion such that each of the multiple polyester weft yarns maintain a physical adjacency between each other during the single insertion event, increasing the thread count of a woven fabric of the bedding material based on the usage of multi-filament polyester weft yarns with a denier between 7 D and 200 D, according to one embodiment.

The bedding is a woven textile fabric that includes from 90 to 250 ends per inch warp yarns and from 100 to 1200 picks per inch multi-filament polyester weft yarns. The total thread count of the bedding material may be from 190 to 1450 and each multi-filament polyester yarn count of the bedding material may have from 7 to 30 filaments each, according to one embodiment.

An example embodiment will now be described. The ACME Textile Corp. may be engaged in production of consumer textiles. For some time, the ACME Textile Corp. may have been facing dipping stock prices caused by significantly lowered sales of its product resulting in fall in profits. The reasons identified for low sales may be attributed to lowered demand due to lack of desirable qualities in its product, e.g., comfort for fabrics that come in contact with human skin, durability, and short useful lifespan of its textile.

To counter the downward trend, the ACME Textile Corp. may have decided to invest in using the textile manufacturing technology described herein for enhancing its textile fabric qualities. The use of various embodiments may have enabled the ACME Textile Corp. to enhance the desirable characteristics of its product. The use of cotton in forming its textile fabric enabled the ACME Textile Corp. to manufacture its product with high absorbency and breathability, thereby increasing comfort to its consumers while wearing.

Further, the use of various embodiments may have allowed the ACME Textile Corp. to produce textile fabric with cotton yarns woven in combination with synthetic fibers such as polyester, thereby increasing lifespan of the textile even when laundered in machine washers and dryers. In addition, the various embodiments may aid the ACME Textile Corp. to produce textile using relatively fine yarns thereby finer fabric with increased thread count per inch of fabric with a smaller denier increasing its quality of the textile, tactile satisfaction, and opulence of its consumers. As a result, the ACME Textile Corp. may now have increased profits due to rise in sales of its fabric.

Although the present embodiments have been described with reference to specific example embodiments, it will be evident that various modifications and changes may be made to these embodiments without departing from the broader spirit and scope of the various embodiments. In addition, the process flows do not require the particular order, or sequential order, to achieve desirable results. In addition, other operations may be provided, or operations may be eliminated, from the described flows, and other components may be added to, or removed from, the described systems. Accordingly, other embodiments are within the scope of the following claims.

I claim:

1. A woven textile fabric comprising:

from 90-250 ends per inch warp yarns; and from 100-1200 picks per inch multi-filament polyester weft yarns, wherein the picks are woven into the textile fabric in groups of at least two multi-filament polyester weft yarns running on a projectile loom, wherein the multi-filament polyester weft yarns are wound in a substantially parallel form to one another and substantially adjacent to one another on a multi-pick yarn package to enable the simultaneous inserting of the multi-filament polyester weft yarns during a single pick insertion event of a pick insertion apparatus of a loom apparatus, wherein the number of the multi-filament polyester weft yarns wound on the weft yarn package using the single pick insertion and in a substantially parallel form to one another and substantially adjacent to one another is at least two, wherein the number of the multi-filament polyester weft yarns conveyed by the pick insertion apparatus across a warp shed of the loom apparatus through a set of warp yarns in the single pick insertion event of the pick insertion apparatus of the loom apparatus is between one and eight, and wherein the multi-filament polyester weft yarns are wound on the multi-pick yarn package at an angle of between 27 and 30 degrees and at a type A shore hardness of between 87 to 90 to enable the simultaneous inserting of the multi-filament polyester weft yarns during the single pick insertion event of the pick insertion apparatus of the loom apparatus.

2. The woven textile fabric of claim 1, wherein the multi-filament polyesters yarn have a denier of 7 D to 200 D.

3. The woven textile fabric of claim 1, wherein the warp yarns are made of a cotton material.

4. The woven textile fabric of claim 3, wherein the multi-filament polyesters yarn have a denier of 7 D to 200 D.

5. The woven textile fabric of claim 4, wherein the multi-filament polyester yarns contain 7 to 30 filaments each.

6. The woven textile fabric of claim 3, wherein a total thread count is from 190 to 1450.

7. The woven textile fabric of claim 5, wherein a minimum tensile strength of the fabric in a warp direction is between 17 kilograms to 65 kilograms, wherein a minimum tensile strength of the fabric in a weft direction is between 11.5 kilograms to 100 kilograms, and wherein a warp-to-fill ratio of the fabric is between 1:2 to 1:4.

8. The woven textile fabric of claim 1, wherein weft yarns within each group run parallel to each other in a plane which substantially includes the warp yarns, and wherein each of the groups is made up of at least four multi-filament polyester weft yarns.

9. A woven textile fabric material comprising:

from 90 to 250 ends per inch warp yarns; and from 100 to 1200 picks per inch multi-filament polyester weft yarns;

wherein the warp yarns are made of a cotton material, wherein the picks are woven into the textile fabric in groups of at least two multi-filament polyester weft yarns running on projectile looms, wherein weft yarns within each group run parallel to each other in a plane which substantially includes the warp yarns, wherein the multi-filament polyester weft yarns are wound in a substantially parallel form to one another and substantially adjacent to one another on a multi-pick yarn package to enable the simultaneous inserting of the multi-filament polyester weft yarns during a single pick insertion event of a pick insertion apparatus of a loom apparatus, wherein the number of the multi-filament polyester weft yarns wound on the weft yarn package in a substantially parallel form to one another and substantially adjacent to one another is at least two, wherein the number of the multi-filament polyester weft yarns conveyed by the pick insertion apparatus across a warp shed of the loom apparatus through a set of warp yarns in the single pick insertion event of the pick insertion apparatus of the loom apparatus is between one and eight, and wherein the multi-filament polyester weft yarns are wound on the multi-pick yarn package at an angle of between 27 and 30 degrees and at a type A shore hardness of between 87 to 90 to enable the simultaneous inserting of the multi-filament polyester weft yarns during the single pick insertion event of the pick insertion apparatus of the loom apparatus.

10. The woven textile fabric of claim 9, wherein a total thread count is from 190 to 1450.

11. The woven textile fabric of claim 9, wherein the multi-filament polyester yarns have a denier of 7 D to 200 D.

12. The woven textile fabric of claim 11, wherein the multi-filament polyester yarns contain 7 to 30 filaments each.

13. The woven textile fabric of claim 12, wherein the fabric has a warp-to-fill ratio between 1:2 to 1:4, wherein the fabric has a minimum tensile strength in a warp direction of 17 kilograms to 65 kilograms, and wherein the fabric has a minimum tensile strength in a weft direction of 11.5 kilograms to 100 kilograms.

14. The woven textile fabric of claim 9, wherein weft yarns within each group run parallel to each other in a plane which substantially includes the warp yarns.

* * * * *